US006391187B1

(12) United States Patent
Eklund et al.

(10) Patent No.: US 6,391,187 B1
(45) Date of Patent: May 21, 2002

(54) METHOD FOR TREATING A METAL PRODUCT

(75) Inventors: Anders Eklund; Malin Snis, both of Avesta (SE)

(73) Assignee: Avesta Sheffield Aktiebolag (PUBL), Stockholm (SE)

( * ) Notice: Subject to any disclaimer, the term of this patent is extended or adjusted under 35 U.S.C. 154(b) by 0 days.

(21) Appl. No.: 09/600,637

(22) PCT Filed: Jan. 28, 1999

(86) PCT No.: PCT/SE99/00115

§ 371 Date: Jul. 20, 2000

§ 102(e) Date: Jul. 20, 2000

(87) PCT Pub. No.: WO99/39028

PCT Pub. Date: Aug. 5, 1999

(30) Foreign Application Priority Data

Feb. 2, 1998 (SE) ..... 9800287

(51) Int. Cl.[7] ..... C25F 1/00; C25F 1/06

(52) U.S. Cl. ..... 205/710; 205/723

(58) Field of Search ..... 205/704, 705, 205/658, 659, 640, 710–711, 723

(56) References Cited

U.S. PATENT DOCUMENTS 5,660,708 A * 8/1997 Tezuka et al. ..... 205/658 X
5,786,556 A * 7/1998 Grönlund et al. ..... 205/705
5,795,460 A * 8/1998 Al-Jiboory et al. ..... 205/705
5,804,056 A * 9/1998 Pempera et al. ..... 205/661

FOREIGN PATENT DOCUMENTS

SE 104091 3/1942
SE 462286 5/1990

* cited by examiner

*Primary Examiner*—Donald R. Valentine
(74) *Attorney, Agent, or Firm*—Nixon & Vanderhye

(57) ABSTRACT

Method of electrolytically continuously treating a material of stainless steel at a current density of 0.1–3 A/cm$^2$, wherein the material is passed through one or more electrolytic cells arranged in series. The cells contain an electrolyte selected from sulphuric acid, a salt thereof, phosphoric acid and nitric acid, and the material is passed through the electrolyte between electrodes arranged in series under the influence of a direct current with alternating polarity. The electrodes are arranged alternately anodic and cathodic and every electrode on one side of said material is matched by an electrode of the same polarity on an opposite side of the material, whereby an oxide surface layer with a thickness of at least 1 micrometer is removed from the material to produce a surface conditioning effect.

38 Claims, 2 Drawing Sheets

METHOD FOR TREATING A METAL PRODUCT

This application is a 371 of PCT/SE99/00115, Jan. 28, 1999.

TECHNICAL FIELD

The present invention relates to a method for electrolytically and continuously treating a hot- and/or cold-worked metal material, particularly a continuously formed one in stainless steel. The treatment method for the material involves removing continuously, in one stage, a surface layer of one or more mixed metal oxides, usually spinel, which surface layer is thicker than the passivation layer which occurs on the surface of stainless steel material, at the same time as a polished surface is obtained. According to the invention, the character of the surface obtained can also be selected by varying a number of control parameters.

PRIOR ART

When manufacturing continuously formed metal products of thin dimensions, i.e. primarily strip, from a stainless steel material, hot rolling is generally carried out followed by the final stage, cold rolling. The operation in that case is first hot rolling of the material at high temperature, at which the material softens and can be rolled to a thickness of around 5–25 mm. Owing to the high temperature, an oxide scale of a thickness of around 50–500 micrometers is formed on hot rolling, which scale consists of a mixed oxide, usually spinel, comprising at least iron and chromium. Spinel is conventionally defined as $AB_2O_4$, A being magnesium, iron(II), zinc or manganese or a combination of these, and B being aluminium, iron(III) or chromium. In the present case, the spinel formed during hot rolling is often of the type $Fe(FeCr_xO_y)$, where x=1–2 and y=2–4 and the chromium content is often up to 40%. Under the oxide scale formed is a chromium-depleted zone with chromium contents down to 10–12% or even lower. Before the material is worked further, the oxide scale has to be removed. A pretreatment can be carried out for this purpose, consisting of annealing at around 1000–1200° C., which softens up the surface, followed by cooling and then blasting which breaks up the oxide scale. After this, a pickling process is normally used, which is an electrolytic treatment stage in an electrolyte consisting of one or more mineral acids or a neutral solution and an ensuing chemical stage. What happens is that the electrolyte/acids penetrate down into cracks in the oxide scale and dissolve the chromium-depleted zone, at which the oxide scale loosens. Following rinsing, the material has a dull, so-called pickled surface. To produce thinner dimensions, the treatment continues with cold rolling, at which the material becomes hard and brittle due to the formation of martensite. To restore the correct material attributes, stress-relieving annealing at around 1000–1200° C. follows, at which however a surface layer again appears of a mixed oxide of the spinel type, this time with a thickness of around 10 micrometers. Since the oxide does not have the right stainless properties, this is also pickled away in the same way as in the earlier process. Following rinsing, the material has a dull, pickled surface. In certain cases, e.g. if further forming operations are to be carried out, the pickled surface. In an advantage, but often a bright surface is desired instead, which is then produced by means of bright annealing in a reducing atmosphere, followed by smoothing rolling with only around 2% reduction of the material thickness. Blasting is not used on cold-rolled material, as the surface is destroyed by this. Instead, so-called neolyte treatment is used, which involves an electrolytic treatment with direct current, usually in sodium sulphate, at which chromium(III) is oxidized to chromium(VI), which is soluble.

A number of methods of pickling have been known for a long time. One such relatively modern method is described in SE-A-9301591-5. In this method, the electrolyte bath consists of mineral acid, for example sulphuric acid, or mixtures of mineral acids and the electrolysis is carried out by means of alternating current or alternately direct current at relatively high current densities, 150–250 A/dm$^2$. The patent also covers the special equipment which is used for the method. When pickling according to SE-A-9301591-5, a dull, pickled surface is produced, as in all known pickling methods, for which reason a subsequent polishing stage consisting of bright annealing and smoothing rolling has to be carried out.

When manufacturing products which are not rolled or continuously formed, i.e. piece products, e.g. pipe parts, tapping cocks, bolts, screws or vessels, in stainless material, a polishing process called electro-polishing is usually performed. This process is a batch-wise electrolysis using direct current in e.g. sulphuric acid and phosphoric acid at relatively low current densities, around 10 A/dm$^2$. The process also takes a relatively long time, often up to 10–20 minutes, in spite of the fact that the oxide layer which is being treated is very thin, around 1–5 nanometers. This layer is the passivation layer which always occurs on the surface of a stainless material and consists of chromic oxide, $Cr_2O_3$. In the process, the material is made to form an anode and a viscous film is then formed on the surface of the material. This film has a higher density, viscosity and resistance than the electrolyte remaining. As the film adjusts itself to the uneven surface of the material, it is thicker in the recesses than on the crests in the surface. In the recesses, the resistance to the passage of current is higher and the current density therefore lower. On the crests, the current is higher on the other hand and the crests thereby come to be dissolved, resulting in a levelling of the surface of the material.

A number of variants of electro-polishing are described in Sweden's Galvanotekniska Förenings (Electroplating Association's) "Lärobok i elektrolytisk och kemisk ytbehandling" ("Manual of electrolytic and chemical surface treatment"), p. 263–271, published by Ytforum Förlag. For the electro-polishing of stainless steel, electrolytes are mentioned consisting of sulphuric acid, ortho-phosphoric acid and water or orthophosphoric acid, glycerol and water. The current density is 7–25 A/dm$^2$ and 7–8 A/dm$^2$ respectively and the time is up to 10 and 15 minutes respectively.

In JP 57-101699/82, a batchwise method of electro-polishing a super-alloyed steel with 60% Ni, 23% Cr, 10% Mo, 3% Fe and 4% Nb is described. The method is used for clock parts and is said to give a figured surface, similar to that which is traditionally obtained by hand grinding. The electrolyte used is a mixture of an aqueous solution of phosphoric acid and an aqueous solution of sulphuric acid in a weight ratio of between 9:1 and 1:1. The electro-polishing takes place over 10 seconds–20 minutes, at a current density of 1–50 A/dm$^2$ and a temperature of 15–50° C.

No continuous method of simultaneously pickling and polishing continuously formed, stainless material is known, as far as the inventors of the present method know. A major disadvantage of the known pickling process for the removal of a surface layer of mixed oxide of the spinel type is that the surface produced remains dull and pickled, for which reason a subsequent stage with bright annealing and smoothing rolling has to be carried out for a highly bright surface to be obtained. Hitherto, however, no-one has thought it possible to obtain a highly bright surface in one and the same step as pickling in continuous treatment of continuously formed stainless products.

SOLUTION AND ADVANTAGES

The preconceived notion that highly bright surfaces cannot be obtained in one and the same stage as continuous pickling of stainless material is thwarted by the present invention.

The method according to the present invention is defined in the independent claim 1 and means that a material of stainless steel, which is preferably continuously formed, in particular strip-formed, is treated continuously, an oxide surface layer of a thickness of at least 1 micrometer being removed from the material and the method achieving a polished effect on the surface of the material in the same stage. This pickling in combination with polishing takes place moreover in a time which is considerably shorter than a conventional pickling stage.

It should be emphasized that the invention, in spite of the fact that it is conceived principally to be applied continuously to continuously formed stainless material, in particular strip, but also thread or pipe, is not restricted to this but can be applied to all stainless material in all forms and thicknesses.

According to an aspect of the invention, the surface layer which is removed is a mixed oxide of the spinel type, comprising at least iron and chromium, and has a thickness of 5–1000 micrometers, preferably 10–500 micrometers. If the material which is being treated has been subjected to hot rolling and annealing, but not cold rolling, the oxide layer has a thickness of 30–1000 micrometers, preferably 50–500 micrometers. If the material has also been subjected to cold rolling, an oxide layer which has arisen afresh has a thickness of 1–30 micrometers, preferably 10–20 micrometers. According to the invention, the same method can be used for removing both the somewhat thicker oxide layer of the spinel type which occurs on hot rolling and annealing and the somewhat thinner oxide layer of the same type which arises on cold rolling and annealing. In both cases, polishing of the surface arises in the same stage.

According to another aspect of the invention, the method is carried out by means of electrolysis with direct current, an electrolyte comprising sulphuric acid or salt thereof and/or phosphoric acid and possibly hydrofluoric acid or salt thereof being used. Simultaneous pickling and a polishing effect occur in an electrolyte consisting purely of phosphoric acid, but it is preferred that the electrolyte also contains a certain amount of sulphuric acid, a suitable interval being 0–95% by volume of sulphuric acid and 5–100% by volume of phosphoric acid. The concentrations are most appropriately 2–12 mol/l, preferably 2–10 mol/l and even more preferredly 2–6 mol/l for sulphuric acid and 2–14 mol/l, preferably 4–12 mol/l and even more preferredly 4–9 mol/l for phosphoric acid, while hydrofluoric acid or salt thereof, if used, is added in a concentration of 1–8 mol/l, preferably 2–7 mol/l and even more preferredly 3–6 mol/l. Iron normally also forms part of the electrolyte, in a quantity of e.g. 30–40 g/l. Iron is released from the material on electrolysis, at which it is concentrated in the electrolyte and does not therefore normally need to be added. As for the rest, the participating ions mainly have the functions of providing conductivity (hydrogen ions of the sulphuric acid) or of providing complex binders for iron (fluorine ions, phosphate ions). In addition to the variants of electrolytes already specified, an electrolyte can be used for example which mainly comprises sodium sulphate and sodium fluoride, the contents being suitably 100–200 g/l, preferably 120–180 g/l and even more preferredly 135–165 g/l for sodium sulphate and 10–70 g/l, preferably 20–60 g/l and even more preferredly 30–50 g/l sodium fluoride. Another variant is sulphuric acid and sodium fluoride, suitable contents being the same as indicated earlier for these chemicals. It is also possible to combine the two last proposed electrolytes, the content being mainly sulphuric acid, sodium sulphate and sodium fluoride according to the amounts indicated earlier. Another variant is sulphuric acid and hydrofluoric acid, the concentrations being most appropriately 2–15 mol/l, preferably 4–10 mol/l and even more preferredly 6–9 mol/l for sulphuric acid and 1–10 mol/l, preferably 2–7 mol/l and even more preferredly 3–6 mol/l for hydrofluoric acid. The electrolyte can also according to the invention mainly comprise nitric acid, which however signifies an undesirable negative effect on the environment. Water can be added if necessary, but can also be present in the amount which forms part of the concentrated acids and which arises due to the absorption of atmospheric humidity. The skilled man will easily understand that the variants of electrolyte compositions can be varied in many more ways, it being a measure of the skilled man to optimize the concentrations.

According to a further aspect of the invention, the treatment time is 30 sec–5 min, preferably 1 min–3 min and even more preferredly around 2 minutes when the starting material is hot-rolled and annealed, or 2 sec–2 min, preferably 5–90 sec. and even more preferredly 10–60 sec. when the starting material is cold-rolled and annealed, with the treatment being able to be carried out in one stage or divided into two or more stages. The anodic current density during electrolysis is 0.1–3 A/cm$^2$, preferably 0.3–2.5 A/cm$^2$ and even more preferredly 0.5–2 A/cm$^2$, and the temperature is 50–100° C., preferably 60–90° C. and even more preferredly 65–80° C.

According to another aspect of the invention, the process can be controlled with the aid of the parameters time, current density, temperature, type of electrolyte, equipment type, material type and desired surface. The stainless types of material can be alloyed with for example chromium, nickel or molybdenum. They can be ferritic, martensitic, duplex, austenitic or superaustenitic, for example. The composition for these stainless types of steel is defined in "Stainless Steel, The New European Standards", 2$^{nd}$ Edition, 1997–02, Avesta Sheffield, but other types of stainless steel can also be treated according to the invention, probably even those which have not yet been developed. The desired surface can be varied from normally dull, i.e. a surface of the same character as is obtained by conventional pickling, to mirror-bright or even bright but grainy, Depending on the material which is being treated and the surface which is desired, the parameters time and current density are selected so as to achieve the desired result. In general, Faraday's Law applies, meaning that the result remains the same if the factor time times current density is kept constant. This theory is not always correct in practice, but as a guideline the factor time times current density is reproduced in the following table in the unit As/cm$^2$ for different materials and different desired surfaces. It is assumed here that a preferred electrolyte with 5 mol/l sulphuric acid and 8 mol/l phosphoric acid is used for electrolysis with direct current, at a temperature of 70° C.

TABLE 1

| Sample | Steel type | Time sec | Current Ampere | Area $cm^2$ | Factor $As/cm^2$ | Surface |
|---|---|---|---|---|---|---|
| 1 | 304 | 45 | 103 | 156.0 | 29.7 | –3– |
| 2 | 304 | 68 | 64 | 114.0 | 30.2 | –3– |
| 3 | 304 | 90 | 41 | 124.0 | 29.8 | –3 |
| 4 | 304 | 113 | 35 | 130.0 | 30.4 | –3 |
| 5 | 316Ti, hot-rolled | 30 | 166 | 204.2 | 24.3 | oxide |
| 6 | 316Ti, hot-rolled | 60 | 181 | 212.8 | 51.0 | 00/oxide |
| 7 | 316Ti, hot-rolled | 120 | 178 | 204.6 | 104.4 | –1 |
| 8 | 316Ti, hot-rolled | 180 | 179 | 209.0 | 154.8 | –3 |

According to another aspect of the invention, the treatment stage is executed in one or more electrolytic cells lying in series, the material being contact-polarized anodically and made to run in an electrolyte between cathodic electrodes under the influence of a direct current. The term "electrode" here and henceforth implies a single electrode or a bundle of electrodes, the latter variant being common in industry and signifying that each electrode bundle functions in practice as one electrode, in that an electrode bundle holds a fixed polarity (cathode or anode). Moreover, the electrodes or electrode bundles may be of different length, with for example a greater total anodic electrode length or a greater total cathodic length.

According to yet another aspect of the invention, the treatment stage is executed in one or more electrolytic cells lying in series, the material being made to run in an electrolyte between electrodes lying in series, under the influence of a direct current with alternating polarity, every other electrode being anodic and every other being cathodic and each electrode being matched by an electrode of the same polarity on the opposite side of the material.

According to another aspect of the invention, the treatment according to the invention can be preceded and/or followed by a chemical surface treatment with mixed acid in one or more cells, preferably using nitric acid and hydrofluoric acid.

An advantage of the method according to the invention is that treatment takes place very quickly. The treatment is 2–10 times faster than conventional pickling and 10–20 times faster than conventional electro-polishing. This means that existing installations, where space is limited for example by an existing annealing furnace and at the other end by existing rinsing equipment for rinsing, can be given an increased line speed in spite of the limited space. The material can thereby be conveyed at a line speed of at least 5 m/min, preferably at least 50 m/min, even more preferredly at least 60 m/min and most preferredly at least 80 m/min.

The invention has at least the following advantages compared with conventional pickling. The method is faster at the same time as two measures are executed in the same step, namely the removal of oxide and achieving a bright surface. The surface cutting is equivalent to or somewhat less than in conventional pickling, for which reason a higher yield can be obtained. The method facilitates a high level of process control and involves relatively little effect on the environment, at least if nitric acid is avoided. The electrolyte chemicals are relatively cheap, especially sulphuric acid, but also phosphoric acid, which commands around half the price of nitric acid. Compared with bright annealing and smoothing rolling, the method means that the investment costs are halved.

DESCRIPTION OF DRAWINGS

The invention will be described below from the drawings and examples.

FIG. 1 shows a production line for treatment of a hot- or cold-rolled strip material in stainless steel. In the following description of the drawing, it is assumed that the a starting material is a hot-rolled strip which thus has an oxide layer of the spinel type according to that which was stated previously. The hot-rolled strip 1 is first placed on a so-called uncoiling capstan 2, after which it runs forward to a cut 3 and a welding device 4, which has the function of welding one strip at its end to the start of a new strip, so that production can continue without any major stoppage to exchange the strip. A stretching and setting mechanism 5 then follows for stretching the strip and adjusting its line speed, which is preferably high, at least 5 m/min, preferably at least 50 m/min, even more preferredly at least 60 m/min and most preferredly at least 80 m/min. In the next stage, the strip passes through a furnace at a temperature of around 1050–1150° C., the function of which is to soften up the oxide on the surface of the strip. A cooling stage 7 then follows, and a blast 8, the objective of which is to break up the oxide scale so that the electrolyte, in a later stage, can penetrate as far as the chromium-depleted zone which lies inside the oxide scale. Following blasting 8 comes the stage which is covered by the present invention, namely a combined pickling and polishing stage, which lies within the dotted lines A and B. In FIG. 1, this stage is divided into three cells 9, 10, 11. In the cells is an electrolyte according to the previous description, the most preferred having the composition 5 mol/l sulphuric acid, 8–8.5 mol/l phosphoric acid and iron (dissolved). Electrolysis in the cells is carried out using direct current at a preferred current density of 0.5–2 $A/cm^2$, a temperature of 70° C. and a total time of around 2 minutes, a bright surface belong obtained on the strip. The principle of how the electrolytic cells can be constructed is evident in greater detail from FIGS. 4 and 5. Following treatment according to the invention in the cells 9, 10, 1, rinsing equipment 12 follows for rinsing of the strip and then a so-called coiling capstan 13. The strip may then advance for cold rolling.

The equipment is suitably adapted so that several different types of material can be treated in the same line. If the section is made long and with several electrolytic cells, an easily treated material can nevertheless be conveyed therein by changing other control parameters, e.g. a lower current density.

Figure 2:
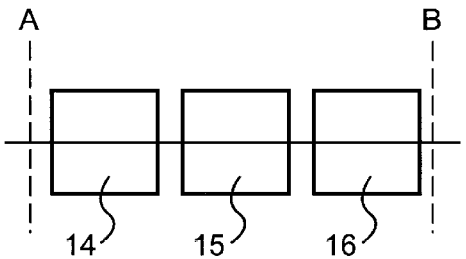
FIG. 2 shows an alternative embodiment, in which pickling polishing is followed by a mixed acid stage.
Figure 3:
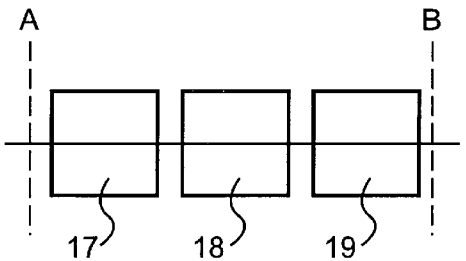
FIG. 3 shows an alternative embodiment, in which pickling polishing is preceded by a mixed acid stage.

In FIG. 2 an alternative embodiment of the cells is shown, in which only the two first cells 14, 15 are electrolytic cells according to the invention, while the cell 16 is a mixed acid cell which can for example contain nitric acid and hydrofluoric acid which are sprayed onto the strip, no electrolysis being carried out but rather a pure acid treatment. With a final mixed acid stage 16 according to FIG. 2, a dull surface is obtained and the grain boundaries appear on the strip, which can be desirable if further forming operations are to follow. The advantage of speed in the introductory stages 14, 15 according to the invention is hereby obtained. In FIG. 3, another conceivable embodiment is shown in which the first two cells 17, 18 are mixed acid cells similar to cell 16 in FIG. 2 and the final cell 19 is a pickling and polishing stage according to the invention.

The choice of cell composition 9, 10, 11 according to FIGS. 1, 14, 15, 16 according to FIG. 2 or 17, 18, 19 according to FIG. 3 is governed by the starting material which is present and the surface which is desired. For a hot-rolled material, FIG. 1 or 2 can be the most preferred, while the most preferred for a cold-rolled strip material is FIG. 1 or 3. The embodiment according to FIG. 2 or 3 has the advantage in this regard that the mixed acid cell/cells can be closed off, in which case only pickling and polishing according to the invention are carried out.

Figure 1:
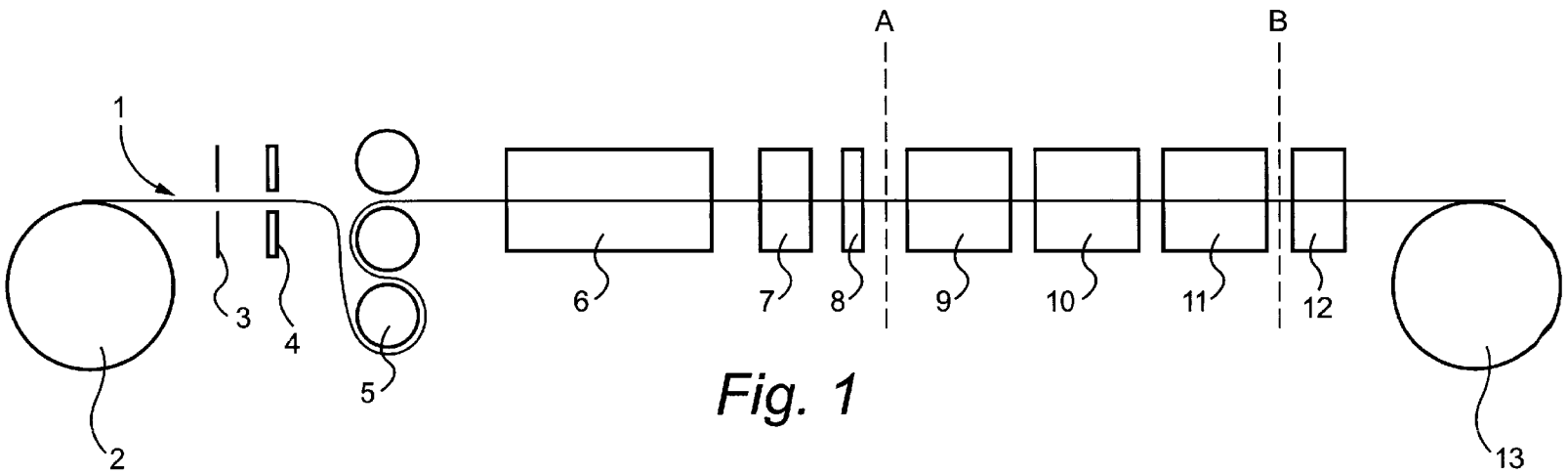
FIG. 1 shows a preferred line for annealing with subsequent pickling and polishing in one stage according to the invention.

The principle for treatment of a cold-rolled material is the same as that shown with reference to FIGS. 1, 2 and 3. The only difference is that a cold-rolled material is not blasted, since this destroys the surface of the strip, in which case a so-called neolyte stage can be used instead as a pretreatment before the pickling and polishing stage. The neolyte stage can be formed by an electrolytic cell with only slight agitation which contains an electrolyte consisting of e.g. sodium sulphate. The neolyte stage is executed using direct current at a current density of around 1–10 A/dm$^2$. When treating a cold-rolled strip material, the furnace also has a somewhat different function, namely to stress-relieve anneal the material.

With a view to the great similarities which exist in the treatment of hot-rolled or cold-rolled material, the line shown according to FIG. 1, 2 or 3 can be executed to advantage as a so-called combined mill, the strip material being made to run through the line twice, first in the hot-rolled state and then in the cold-rolled state. However, it is not always necessary to cold roll the strip. The hot-rolled strip which has been treated according to the invention has a very attractive surface and can advantageously be used directly e.g. as structural steel.

Figure 4:
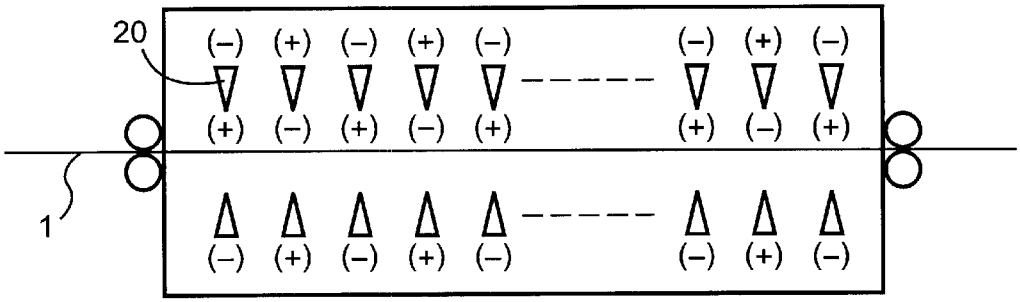
FIG. 4 shows diagrammatically a preferred electrolytic cell for execution of the method according to the invention.
Figure 5:
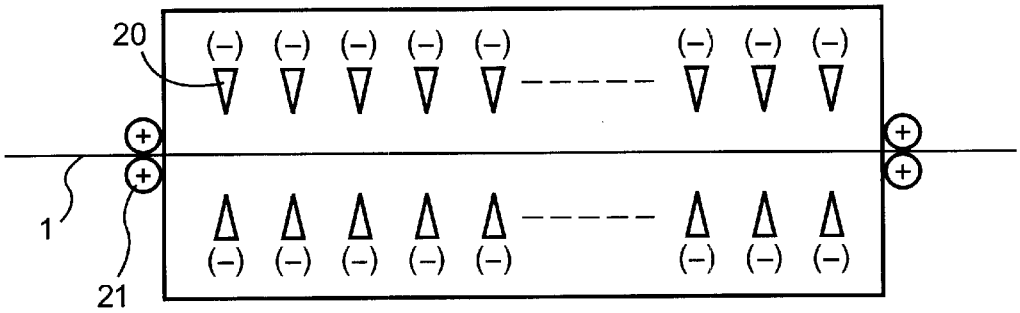
FIG. 5 shows diagrammatically an alternative electrolytic cell for execution of the method according to the invention.

FIG. 4 shows a preferred embodiment of an electrolytic cell for carrying out the method according to the invention. The principle is termed direct current with alternating polarity and is known in itself per se. It starts out from the fact that the strip 1 is kept stretched and made to run in an electrolyte between a number of pairs of electrodes lying in series. Each electrode 20 in a pair has the same polarity and every other electrode pair is cathodic and every other anodic. A current is hereby induced in the strip material lying in between, its polarity coming to alternate go that the strip material has cathodic polarity when it is between an anodic electrode pair and anodic polarity when it is between a cathodic electrode pair. The strip material should preferably be rendered anodic for at least 50% of its length. The electrodes may advantageously be arranged so that the cathodic electrodes have a greater total length than the anodic electrodes, whereby the strip material is rendered anodic for at least 60% of its length, preferably at least ⅔ of its length. In FIG. 5, an alternative embodiment is shown in which the strip material is contact-polarized anodically via roller pairs 21. Each pair of electrodes here is cathodic. In addition to the embodiments shown, other, conventional principles can be utilized, such as a variant similar to that in FIG. 4, for example, but in which the two electrodes in an electrode pair are of opposing polarity, but where however every other electrode is cathodic and every other anodic on a given side of the strip.

The electrodes can e.g. be executed in lead, titanium, stainless steel or graphite.

To facilitate the appearance of a film on the surface of the material, similar to that which occurs in electro-polishing, it is preferred that only moderate agitation takes place in the electrolytic cell. A preferred cell resembles the known neolyte cell in respect of turbulence. A certain agitation always occurs due to the movement of the strip and circulation of the electrolyte. The effect of pickling and polishing can also be deliberately controlled by the turbulence which can be produced in the cell.

EXAMPLE 1

A series of tests was carried out with the aim of investigating how the surface finish of different types of steel can be varied with the polishing time. The tests were conducted in a vat which is normally used for electrolyte treatment. This vat was used in the series of tests so as to facilitate favourable conditions for polishing, such as relatively high current densities and not too much agitation. The cathodes consisted of stainless 316L material, the thickness of which was 2 mm. The sample, which was to be pickled and polished, was placed between two cathodes and came thereby to be polished on both sides. The distance between the cathode and sample was 5.5 cm. The electrolyte consisted of sulphuric acid, phosphoric acid and iron. Following the combined pickling and polishing according to the invention, the samples were rinsed with water and washed thereafter with high-pressure washing. The samples were then judged visually according to the following marking system:

| | |
|---|---|
| oxide: | remaining oxide visible on the surface |
| 00: | trace of polishing |
| −1: | rather dull polished surface |
| −2: | polished surface |
| −3: | mirror-bright polished surface |

Note that −3−signifies a brighter surface than −3.

The test conditions and results are shown in Table 2. All the material is cold-rolled unless otherwise specified.

TABLE 2

| Sample | Steel type | Temp. ° C. | Time Secs. | Current density A/cm$^2$ | Surface | Surface cutting g/m$^2$ |
|---|---|---|---|---|---|---|
| 1 | 153MA | 72.9 | 30 | 0.78 | 00 | 25.84 |
| 2 | 153MA | 73.9 | 45 | 0.84 | −1 | 41.76 |
| 3 | 153MA | 75.5 | 120 | 0.84 | −3 | 119.02 |
| 4 | 904L | 74.7 | 7 | 0.87 | −3 | 7.44 |
| 5 | 904L | 74.7 | 15 | 0.84 | −3− | 15.08 |
| 6 | 2205 | 75.7 | 5 | 0.81 | −3− | 4.00 |
| 7 | 316Ti, hot-rolled | 73.5 | 30 | 0.81 | oxide | 55.33 |
| 8 | 316Ti, hot-rolled | 74.2 | 60 | 0.85 | 00/ oxide | 89.00 |
| 9 | 316Ti, hot-rolled | 74.7 | 120 | 0.87 | −1 | 158.60 |
| 10 | 316Ti, hot-rolled | 76.9 | 180 | 0.86 | −3 | 214.59 |
| 11 | 409 | 73.5 | 5 | 0.78 | −1 | 5.84 |
| 12 | 409 | 73.0 | 15 | 0.75 | −3− | 13.17 |
| 13 | 316L | 72.5 | 5 | 0.74 | −3− | 3.54 |
| 14 | 304 | 72.4 | 30 | 0.78 | −2 | 24.34 |
| 15 | 304 | 72.9 | 60 | 0.77 | −3− | 50.39 |
| 16 | 430 | 74.7 | 60 | 0.76 | −1 | 48.94 |
| 17 | 304, hot-rolled | 71.2 | 60 | 0.87 | 00- | 57.71 |
| 18 | 304, hot-rolled | 73.5 | 120 | 0.90 | −1 | 120.20 |
| 19 | 304, hot-rolled | 76.3 | 180 | 0.96 | −3− | 194.80 |
| 20 | 303 ASR wire | 73.7 | 240 | 2.40 | −3 | – |
| 21 | 316Cu ASR wire | 75.0 | 75 | 2.80 | −3− | – |

At least the following conclusions can be drawn from Table 2:

Samples 1–3: After 30 s, the surface shows only a trace of polishing, but after 120 s it is mirror-bright and polished.

Samples 4–5: After just 7 s the surface is mirror-bright and polished. After 15 s it is highly bright.

This points to the fact that the steel types are very easily polished using the present method.

Samples 6 and 13: After just 5 s the surface is highly bright. This indicates that the steel types are very easily polished using the present method.

Samples 7–10, 11–12, 14–15, 17–19: These series show a clear time dependence for the various types of steel and that certain types of steel (e.g. 304) are considerably quicker to treat than others (e.g. 316Ti). Samples 11–12 also show that a ferritic material, which has a denser oxide, is quicker to treat.

Sample 16: Shows that more time or a higher current density would be needed for this type of steel.

Samples 20 and 21: Show that also wire can be treated satisfactorily with the method according to the invention.

EXAMPLE 2 at A series of tests was carried out with the aim of investigating suitable ratios between sulphuric acid and phosphoric acid in a preferred electrolyte. The electrolytes consisted only of concentrated acids without the addition of water or the addition of iron. The tests were conducted on a small scale in a beaker at room temperature and with moderate agitation by means of a magnetic agitator. The surfaces were judged in the same way as in Example 1.

The electrolyte compositions and results are shown in Table 3.

TABLE 3

| $H_2SO_4/H_3PO_4$ vol-% | Surface |
|---|---|
| 100/0 | Attacked surface |
| 95/5 | –1 |
| 70/30 | –3– |
| 50/50 | –3– |
| 30/70 | –3– |
| 5/95 | –3 |
| 0/100 | –3+ |

The series of tests shows that simultaneous pickling and polishing in only sulphuric acid does not give good results, but in only phosphoric acid the results are relatively good. The best results are achieved in the range 70/30–30/70.

The invention is not restricted to what has been presented in the embodiments and examples specified above, but can be varied within the scope of the claims. It should for example be considered a specialist measure to optimize the parameters for a treatment stage according to the invention. In particular, the variants can be innumerable if two or more electrolytic cells operating according to the invention are placed in series, each cell naturally being capable of being optimized in a way which differs from the adjacent ones.

What is claimed is:

1. Method of electrolytically continuously treating a material of stainless steel at a current density of 0.1–3 A/cm$^2$, comprising passing said material through one or more electrolytic cells arranged in series, said electrolytic cells containing an electrolyte selected from the group consisting of sulphuric acid, a salt of sulphuric acid, phosphoric acid and nitric acid, said material passing through said electrolyte between electrodes arranged in series and under the influence of a direct current with alternating polarity, said electrodes being arranged alternately anodic and cathodic with every electrode on one side of said material being matched by an electrode of the same polarity on an opposite side of the material, whereby an oxide surface, layer with a thickness of at least 1 micrometer is removed from the material to produce a surface conditioning effect.

2. Method according to claim 1, wherein the oxide surface layer which is removed comprises a mixed oxide consisting of at least iron and chromium, and has a thickness of 1–1000 micrometers.

3. Method according to claim 2, wherein the oxide surface layer has a thickness of 10–500 micrometers.

4. Method according to claim 1, wherein the material is continuously formed.

5. Method according to claim 1, wherein the material in an earlier stage is subjected to hot rolling and annealing, at which said oxide surface layer is formed and has a thickness of 30–1000 micrometers.

6. Method according to claim 5, wherein the method is performed by electrolysis using a direct current over a treatment time of 30 sec–5 min.

7. Method according to claim 6, wherein the treatment time is 1 min–3 min.

8. Method according to claim 6, wherein the treatment time is around 2 minutes.

9. Method according to claim 5, wherein, after said hot rolling and annealing and removal of said oxide surface layer, the material is subjected to cold rolling and a second annealing in which a second oxide surface layer with a thickness of 1–30 micrometers is formed during said second annealing, said second oxide surface layer being removed in the same stage as a polishing effect is achieved on the surface of the material.

10. Method according to claim 9, wherein said second oxide surface layer has a thickness of 10–20 micrometers.

11. Method according to claim 9, wherein the method is performed by electrolysis using direct current over a treatment time of 2 sec–2 min.

12. Method according to claim 11, wherein the treatment time is 5–90 sec.

13. Method according to claim 11, wherein the treatment time is 10–60 sec.

14. Method according to claim 1, wherein the material in an earlier stage is subjected to hot rolling and annealing, at which said oxide surface layer is formed and has a thickness of 50–500 micrometers.

15. Method according to claim 1, wherein the electrolyte also contains hydrofluoric acid or salt thereof.

16. Method according to claim 1, wherein said electrolyte comprises sulphuric acid in a concentration of 2–12 mol/l and phosphoric acid in a concentration of 2–14 mol/l.

17. Method according to claim 16, wherein said electrolyte comprises sulphuric acid in a concentration of 2–10 mol/l and phosphoric acid in a concentration of 4–12 mol/l.

18. Method according to claim 16, wherein said electrolyte comprises sulphuric acid in a concentration of 2–6 mol/l and phosphoric acid in a concentration of 4–9 mol/l.

19. Method according to claim 1, wherein said electrolyte comprises sodium sulphate and sodium fluoride.

20. Method according to claim 1, wherein said electrolyte comprises sulphuric acid and sodium fluoride.

21. Method according to claim 1, wherein said electrolyte comprises sulphuric acid, sodium sulphate and sodium fluoride.

22. Method according to claim 1, wherein the current density during electrolysis is 0.3–2.5 A/cm$^2$ or 0.74–3 A/cm$^2$.

23. Method according to claim 22, wherein the current density during electrolysis is 0.5–2 $A/cm^2$ or 0.74–2.5 $A/cm^2$.

24. Method according to claim 22, wherein the current density during electrolysis is 0.74–2 $A/cm^2$.

25. Method according to claim 1, wherein the strip material is rendered anodic for at least 50% of its length.

26. Method according to claim 25, wherein the strip material is rendered anodic for at least 60% of its length.

27. Method according to claim 25, wherein the strip material is rendered anodic for at least ⅔ of its length.

28. Method according to claim 1, wherein the temperature during treatment is 50–100° C.

29. Method according to claim 28, wherein the temperature during treatment is 60–90° C.

30. Method according to claim 28, wherein the temperature during treatment is 65–80° C.

31. Method according to claim 1, wherein the treatment stage is preceded by a chemical surface treatment with mixed acid in one or more cells.

32. Method according to claim 31, wherein said mixed acid is nitric acid and hydrofluoric acid.

33. Method according to claim 1, wherein the treatment stage is followed by a chemical surface treatment with mixed acid in one or more cells.

34. Method according to claim 33, wherein the mixed acid is nitric acid and hydrofluoric acid.

35. Method according to claim 1, wherein the material is conveyed at a line speed of at least 5 m/min.

36. Method according to claim 35, wherein the material is conveyed at a line speed of at least 50 m/min, even more preferred at least 60 m/min and most preferred at least 80 m/min.

37. Method according to claim 35, wherein the material is conveyed at a line speed of at least 60 m/min.

38. Method according to claim 35, wherein the material is conveyed at a line speed of at least 80 m/min.

* * * * *